US008786387B2

(12) United States Patent
Fong et al.

(10) Patent No.: US 8,786,387 B2
(45) Date of Patent: Jul. 22, 2014

(54) MAGNETIC ACTUATOR

(75) Inventors: Robert Fong, Bethlehem, PA (US); Geoffrey Reed, East Stroudsburg, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 13/526,593

(22) Filed: Jun. 19, 2012

(65) Prior Publication Data

US 2013/0009731 A1 Jan. 10, 2013

Related U.S. Application Data

(60) Provisional application No. 61/504,780, filed on Jul. 6, 2011.

(51) Int. Cl.

| | |
|---|---|
| ***H01H 9/00*** | (2006.01) |
| ***H01H 51/01*** | (2006.01) |
| ***H01H 51/22*** | (2006.01) |
| ***H01H 50/34*** | (2006.01) |
| ***H01H 51/24*** | (2006.01) |

(52) U.S. Cl.

CPC ..... *H01H 51/01* (2013.01); *H01H 51/2209* (2013.01); *H01H 50/34* (2013.01); *H01H 51/24* (2013.01)

USPC ..... 335/179; 335/229; 335/230; 335/274

(58) Field of Classification Search

CPC ... H01H 50/34; H01H 51/01; H01H 51/2209; H01H 51/24

USPC ..... 335/179, 229–234, 274

See application file for complete search history.

(56) References Cited

U.S. PATENT DOCUMENTS

| | | | | |
|---|---|---|---|---|
| 3,893,053 | A | 7/1975 | Onatsevich | |
| 3,988,706 | A | 10/1976 | Springer | |
| 4,312,494 | A | 1/1982 | Aoyama | |
| 5,287,939 | A | 2/1994 | Fernandez | |
| 5,836,001 | A | 11/1998 | Hielkman et al. | |
| 6,047,718 | A | 4/2000 | Konsky et al. | |
| 6,175,292 | B1 | 1/2001 | Gruden | |
| 6,265,957 | B1 | 7/2001 | Baginski et al. | |
| 6,367,433 | B2 | 4/2002 | Oyama et al. | |
| 6,566,990 | B2 | 5/2003 | Oyama et al. | |
| 6,590,483 | B2 | 7/2003 | Suzuki | |
| 6,677,844 | B1 | 1/2004 | Gorospe et al. | |
| 6,737,766 | B1 | 5/2004 | Burrola et al. | |
| 6,759,934 | B2 | 7/2004 | Bircann et al. | |
| 6,918,571 | B1 | 7/2005 | Rose | |
| 7,315,230 | B2 | 1/2008 | Hoffman | |
| 7,832,707 | B2 | 11/2010 | Shigeta et al. | |
| 2007/0171016 | A1 * | 7/2007 | Bonjean et al. | 335/234 |

* cited by examiner

*Primary Examiner* — Ramon Barrera

(74) *Attorney, Agent, or Firm* — Snyder, Clark, Lesch & Chang, LLP

(57) ABSTRACT

A magnetic actuator includes a coil bobbin that has electrical wire wound around a core. The magnetic actuator also includes a plunger located in a central portion of the magnetic actuator and configured to move within a bore located in the central portion, and at least one spring located adjacent the central portion. When electrical current is provided to the electrical wire, an electromagnetic field causes the plunger to move from a first position to a second position, and stored energy associated with the spring aids in moving the plunger to the second position. The magnetic actuator further includes a linking portion coupled to the plunger, wherein the linking portion is configured to initiate an action based on movement of the plunger.

20 Claims, 4 Drawing Sheets

MAGNETIC ACTUATOR

RELATED APPLICATION

This application claims priority under 35 U.S.C. §119 based on U.S. Provisional Patent Application No. 61/504,780, filed Jul. 6, 2011, the disclosure of which is hereby incorporated herein by reference.

BACKGROUND INFORMATION

Magnetic actuators typically include a relatively long spring that is located inside the center of the actuator mechanism. In many instances, the length of the spring adds to the overall length of the enclosure that houses the magnetic actuator. As a result, conventional magnetic actuators are too long to be used in many installations due to the overall length of the actuator and housing.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Embodiments described herein provide a magnetic actuator that has a low profile and consumes less space than a conventional magnetic actuator. For example, in one embodiment, a magnetic actuator includes two springs located adjacent a central portion of the magnetic actuator. The two springs allow the magnetic actuator to be shorter in length than conventional actuators. In another embodiment, a single spring may be located around the circumference of the central portion of the magnetic actuator. In this embodiment, the single spring may also allow the magnetic actuator to be contained in an enclosure that is shorter in length than enclosures used to house conventional magnetic actuators. In each case, embodiments described herein allow a magnetic actuator to be used in scenarios where space is at a premium.

Figure 1:
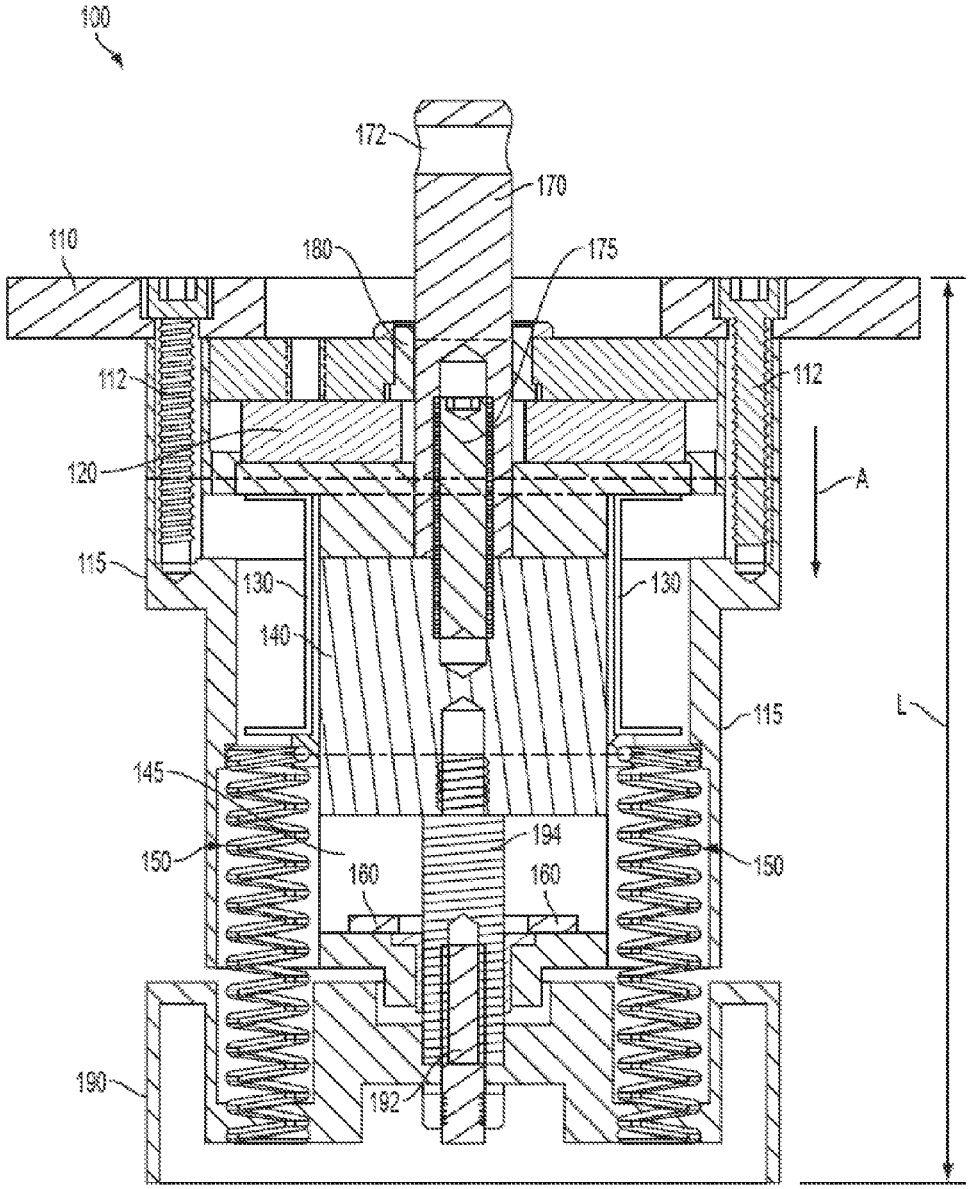
FIG. 1 is a cross-sectional view of a magnetic actuator consistent with an exemplary embodiment.

FIG. 1 is a cross-sectional view of a magnetic actuator 100 in accordance with an exemplary embodiment. Referring to FIG. 1, magnetic actuator 100 may include mounting plate 110, housing 115, booster magnet 120, coil bobbin 130, plunger 140, springs 150, back stop 160, pull rod linker 170, plunger connector 175, collar 180 and spring disk 190. The exemplary configuration illustrated in FIG. 1 is provided for simplicity. It should be understood that actuator 100 may include more or fewer devices than illustrated in FIG. 1. For example, the coil windings associated with coil bobbin 130 are not shown for simplicity.

Mounting plate 110 may allow magnetic actuator 100 to be mounted to another structure. For example, mounting plate 110 may include openings for screws 112 to allow magnetic actuator 100 to be mounted within an enclosure or a cabinet, to switchgear, etc. As illustrated in FIG. 1, in one embodiment, mounting plate 110 may include two screws 112 that are used to secure mounting plate 110 to housing 115.

Housing 115 may be an enclosed structure that houses the components (e.g., booster magnet 120, coil bobbin 130, plunger 140, springs 150, back stop 160, etc.) of magnetic actuator 100. Housing 115 may be metal, plastic or a composite material.

Booster magnet 120 may include a conventional magnet that is used to hold plunger 140 adjacent booster magnet 120 when coil bobbin 130 is not energized, as shown in FIG. 1. Booster magnet 120 may also aid in moving plunger 140 in a linear direction when electricity is applied to the coil/wire (not shown) wound on coil bobbin 130, as described in more detail below.

Coil bobbin 130 may include a bobbin used to hold a coil of wire (not shown in FIG. 1 for simplicity) wound around the core of coil bobbin 130. In an exemplary implementation, the core of coil bobbin may be made of a metallic material, such as iron or steel. An electrical power source (not shown in FIG. 1) may be coupled to the coil of wire of coil bobbin 130. When the windings of coil bobbin 130 become energized, coil bobbin 130 acts as an electromagnet to move plunger 140 in the linear direction illustrated by the arrow labeled A in FIG. 1. That is, the electrical current provided to the coil bobbin 130 breaks the magnetic field holding plunger 140 to booster magnet 120 and acts to move plunger 140 in the direction of arrow A.

Plunger 140 may be made from a metallic material, such as iron, steel or some other metal that may be magnetic. Plunger 140 may be located in the central portion of magnetic actuator 100. For example, referring to FIG. 1, the upper portion of plunger 140 may be located adjacent booster magnet 120. Plunger 140 may move within opening/bore 145 when coil bobbin 130 generates a magnetic field in response to current being applied to coil bobbin 130. This linear motion of plunger 140 may be used to perform an operation (e.g., open/close a circuit breaker), as described in more detail below.

Booster magnet 120, as illustrated in FIG. 1, may be located adjacent the upper portion of plunger 140 and may be a permanent magnet. The magnetic field of booster magnet 120 may be oriented to hold plunger 140 adjacent booster magnet 120 in the position illustrated in FIG. 1. When coil bobbin 130 is energized, the electromagnetic field created by coil bobbin 130 breaks the magnetic field of booster magnet 120 holding plunger 140. As a result, plunger 140 moves in the direction illustrated by arrow A.

As described above, magnetic actuator 100 may include two inner springs 150 located within housing 115. Springs 150 may include coil springs or other types of springs. Spring disk 190 may include a housing that is coupled to the lower portion of plunger 140. For example, referring to FIG. 1, spring disk 190 may include a spring disk coupler 192 that connects spring disk 190 to plunger 140 via plunger coupler 194. Spring disk 190 may provide a tension or compressive force on springs 150 to create a stored energy in springs 150 when plunger 140 is located in the position illustrated in FIG. 1. This stored energy may be used to aid in movement of plunger 140 when coil bobbin 130 is energized.

For example, referring to FIG. 1, when plunger 140 moves in the direction of arrow A, the downward force on plunger 140 moves spring disk 190 and allows springs 150 to use the stored energy and assist in movement of plunger 140. That is, the stored energy may be released to allow springs 150 to aid in moving plunger 140. Spring disk 190 may also include a label that will indicate to a user whether a circuit breaker coupled to magnetic actuator 100 is in the open or closed position.

Back stop 160 may act as a restraining point to stop plunger 140 from moving past back stop 160. That is, back stop 160 may act to control the distance of travel of plunger 140. The distance of travel, also referred to as the stroke distance, may be used to operate or effect actuation of another device, such as open/close a circuit breaker.

Pull rod linker 170 may be part of a pull rod assembly (not shown) that uses the linear motion of plunger 140 to effect a desired operation. For example, in one implementation, pull rod linker 170 may connect to a pull rod that is used to open/close a vacuum circuit breaker based on the linear motion of the pull rod, as described in more detail below. Pull rod linker 170 may include a portion, labeled 172 in FIG. 1, to which a pull rod may be attached. In alternative implementations, the upper portion of pull rod linker 170 may be threaded to receive a pull rod.

Plunger connector 175 may couple pull rod linker 170 to plunger 140 so that movement of plunger 140 is translated to movement of pull rod linker 170. In other words, pull rod linker 170 acts to provide a pulling force on a pull rod assembly to actuate an operation, such as open/close a circuit breaker. A collar 180 or other mechanical coupling mechanism located adjacent booster magnet 120 may secure pull rod linker 170 within magnetic actuator 100 and allow pull rod linker 170 to move up/down as plunger 140 moves.

As described above, in conventional magnetic actuators, a single central spring may compress when the magnetic actuator is energized. Typically, the spring is relatively long and significantly adds a to the overall length of the magnetic actuator. In accordance with the implementation described above with respect to FIG. 1, two springs 150 located within the magnetic actuator 100 housing 115 enable magnetic actuator 100 to be much smaller (e.g., have a shorter profile) than conventional magnetic actuators. For example, in accordance with one implementation, magnetic actuator 100 may have an overall length (labeled L in FIG. 1) ranging from approximately 4.0 inches to approximately 6.0 inches. In one particular implementation in which magnetic actuator 100 is used to open/close a vacuum circuit breaker, L may be approximately 5.66 inches in length. In other implementations, L may be less than four inches in length or greater than six inches in length. In each case, using two inner springs 150, as opposed to a single central spring allows magnetic actuator 100 to have a shorter/lower profile such that magnetic actuator can be used in a number of scenarios in which space is at a premium.

Figure 2:
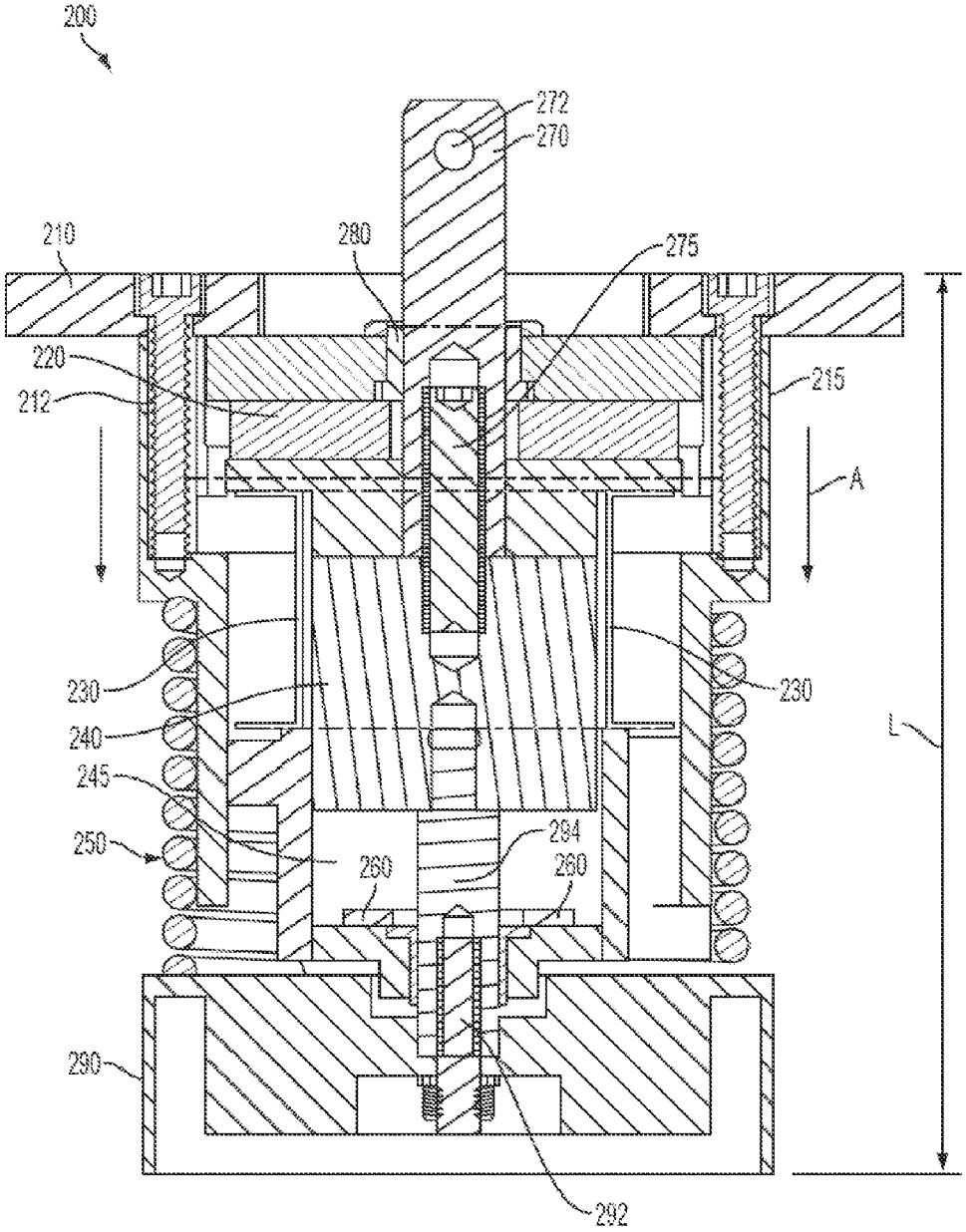
FIG. 2 is a cross-sectional view of a magnetic actuator consistent with another exemplary embodiment.

FIG. 2 is a cross-sectional view of a magnetic actuator 200 in accordance with another exemplary embodiment. Referring to FIG. 2, magnetic actuator 200 may include mounting plate 210, mounting screws 212, housing 215, booster magnet 220, coil bobbin 230, plunger 240, spring 250, back stop 260, pull rod linker 270, plunger connector 275, collar 280 and spring disk 290. The exemplary configuration illustrated in FIG. 2 is provided for simplicity. It should be understood that actuator 200 may include more or fewer devices than illustrated in FIG. 2. For example, the coil windings associated with coil bobbin 230 are not shown for simplicity.

Mounting plate 210, similar to mounting plate 110 described above with respect to FIG. 1, may allow magnetic actuator 200 to be mounted to another structure. For example, mounting plate 210 may include openings for screws 212 to allow magnetic actuator 200 to be mounted within an enclosure or a cabinet, to switchgear, etc. As illustrated in FIG. 2, in one embodiment, mounting plate 210 may include two screws 212 that are used to secure mounting plate 210 to housing 215.

Booster magnet 220 may include a conventional (e.g., permanent) magnet that is used to hold plunger 240 adjacent booster magnet 220 when coil bobbin 230 is not energized, as shown in FIG. 2. Booster magnet 220 may also aid in moving plunger 240 in a linear direction when electricity is applied to the coil/wire (not shown) wound on coil bobbin 230, as described in more detail below.

Coil bobbin 230 may include a bobbin used to hold a coil of wire (not shown in FIG. 2 for simplicity) wound around the core of coil bobbin 230. In an exemplary implementation, the core of coil bobbin may be made of a metallic material, such as iron or steel. An electrical power source (not shown in FIG. 2) may be coupled to the coil of wire of coil bobbin 230 to provide current to the wire/windings. When the windings of coil bobbin 230 become energized, coil bobbin 230 acts as an electromagnet to move plunger 240 in the linear direction illustrated by the arrow labeled A in FIG. 2. That is, the electrical current provided to coil bobbin 230 generates a magnetic field that breaks the magnetic field of booster magnet 220 holding plunger 240. As a result, plunger 240 moves in the direction illustrated by arrow A.

Plunger 240 may be made from a metallic material, such as iron, steel or some other metal that may be magnetic. Plunger 240 may be located in the central portion of magnetic actuator 200. For example, referring to FIG. 2, the upper portion of plunger 240 may be located adjacent booster magnet 220. Plunger 240 may move within opening/bore 245 when coil bobbin 230 generates a magnetic field in response to current being applied to coil bobbin 230. This linear motion of plunger 240 may be used to perform an operation (e.g., open/close a circuit breaker), as described in more detail below.

Booster magnet 220, as illustrated in FIG. 2, may be located adjacent the upper portion of plunger 240 and may be a permanent magnet. The magnetic field of booster magnet 220 may be oriented to hold plunger 240 adjacent booster magnet 220 in the position illustrated in FIG. 2. When coil bobbin 230 is energized, the electromagnetic field created by coil bobbin 230 breaks the magnetic field of booster magnet 220 holding plunger 240 and plunger 240 moves in the direction illustrated by arrow A.

As described above, magnetic actuator 200 may include a spring 250 located externally with respect to housing 215. Spring 250 may be a helically wound spring or another type of spring that surrounds the circumference of the center portion of magnetic actuator 200. Spring disk 290 may include a housing that is coupled to the lower portion of plunger 240. For example, referring to FIG. 2, spring disk 290 may include a spring disk coupler 292 that connects spring disk 290 to plunger 240 via plunger coupler 294. Spring disk 290 may provide a tension or compressive force on spring 250 to create a stored energy in spring 250 when plunger 240 is located in the position illustrated in FIG. 2. This stored energy may be used to aid in movement of plunger 240 when coil bobbin 230 is energized.

For example, referring to FIG. 2, when plunger 240 moves in the direction of arrow A, the downward force on plunger 240 moves spring disk 290 and allows spring 250 to use the stored energy and assist in movement of plunger 240. That is, the stored energy may be released to allow spring 250 to aid in moving plunger 240. Spring disk 290 may also include a label that will indicate to a user whether a circuit breaker coupled to magnetic actuator 200 is in the open or closed position.

Back stop 260 may act as a restraining point to stop plunger 240 from moving past back stop 260. That is, back stop 260 may act to control the distance of travel of plunger 240. The distance of travel, also referred to as the stroke distance, may be used to operate or effect actuation of another device, such as open/close a circuit breaker.

Pull rod linker 270 may be part of a pull rod assembly (not shown) that uses the linear motion of plunger 240 to effect a desired operation. For example, in one implementation, pull rod linker 270 may connect to a pull rod that is used to open/close a vacuum circuit breaker based on the linear motion of the pull rod, as described in more detail below. Pull rod linker 270 may include an opening 272 to which a pull rod may be inserted or attached. In alternative implementations, the upper portion of pull rod linker 270 may be threaded to receive a pull rod.

Plunger connector 275 may couple pull rod linker 270 to plunger 240 so that movement of plunger 240 is translated to movement of pull rod linker 270. In other words, pull rod linker 270 acts to provide a pulling force on a pull rod assembly to open/close a breaker or actuate another operation. A collar 280 or other mechanical coupling mechanism located adjacent booster magnet 220 may secure pull rod linker 270 within magnetic actuator 200 and allow pull rod linker 270 to move up/down as plunger 240 moves.

As described above, in conventional magnetic actuators, a single spring located in the center of the magnetic actuator may compress when the magnetic actuator is energized. In accordance with the implementation described above with respect to FIG. 2, spring 250 located externally with respect to housing 215 and around the circumference of the central portion of magnetic actuator 200 enables magnetic actuator 200 to be much smaller (e.g., have a shorter profile) than conventional magnetic actuators. For example, in accordance with one implementation, magnetic actuator 200 may have an overall length (labeled L in FIG. 2) ranging from approximately 4.0 inches to approximately 6.0 inches. In one particular implementation in which magnetic actuator 200 is used to open/close a vacuum circuit breaker, L may be approximately 5.66 inches in length. In other implementations, L may be less than four inches in length or greater than six inches in length. In each case, using a single spring located around the circumference of housing 215, as opposed to a single central spring located in the central portion of a magnetic actuator, allows magnetic actuator 200 to have a shorter/lower profile such that magnetic actuator 200 can be used in a number of scenarios in which space is at a premium.

Figure 3:
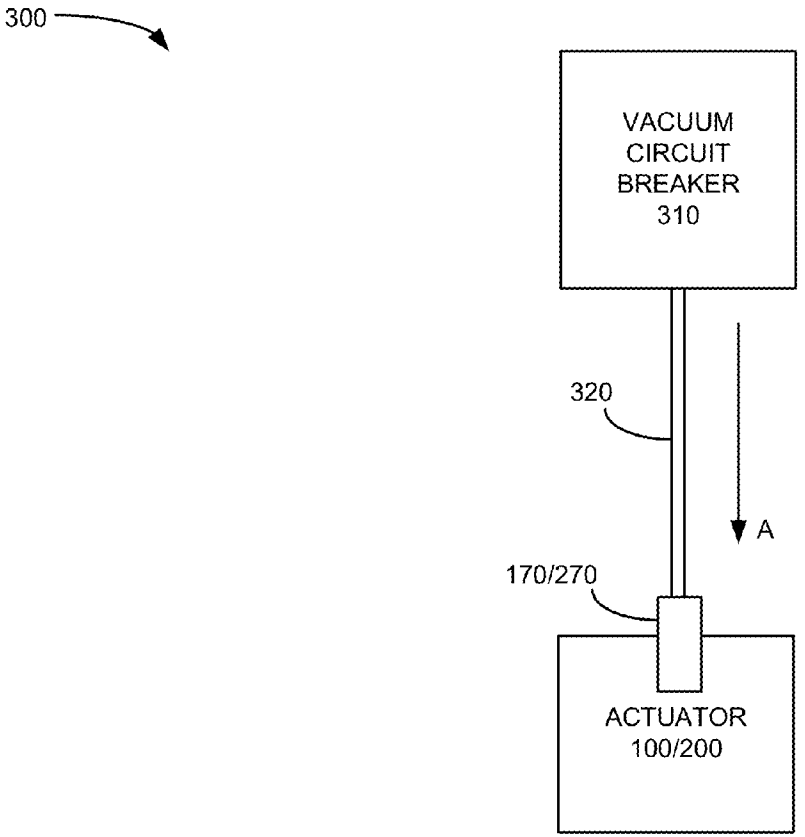
FIG. 3 is a block diagram illustrating use of the magnetic actuator in a system including a circuit breaker.

As described above, magnetic actuator 100 or 200 may be used in a number of implementations in which conventional magnetic actuators may not be used due to, for example, space considerations. FIG. 3 is a simplified block diagram of an exemplary environment 300 in which magnetic actuator 100 or 200 may be used. Referring to FIG. 3, environment 300 includes magnetic actuator 100 or 200, vacuum circuit breaker 310 and pull rod assembly 320. Pull rod assembly 320 may include a cable or some other structure that couples pull rod linker 170/270 of magnetic actuator 100/200 to vacuum circuit breaker 310. As described above with respect to FIGS. 1 and 2, pull rod assembly 170/270 may be coupled to magnetic actuator 100/200 via a clamping mechanism, a threaded connection, a bolt-on connection or via some other mechanism. Pull rod assembly 320 may move in direction A illustrated in FIG. 3 in response to movement of plunger 140 or 240. The linear movement of pull rod assembly 320 may be used to open or close vacuum circuit breaker 310. For example, in one embodiment, the movement of pull rod assembly 170/270 may move pull rod assembly 320 to open the contacts of vacuum circuit breaker 310. Alternatively, movement of pull rod assembly 320 may actuate a trip mechanism to open or close vacuum circuit breaker 310. In each case, magnetic actuator 100 or 200 may be used to trip vacuum circuit breaker 310 at the appropriate time based on the particular conditions/requirements associated with operating conditions in environment 300.

Once magnetic actuator 100 or 200 is activated, the contacts in vacuum circuit breaker 310 are opened/closed, based on the particular implementation. After actuation, the electrical current applied to coil bobbin 130 or 230 may be removed and the contacts in vacuum circuit breaker 310 remain in the desired position.

Figure 4:
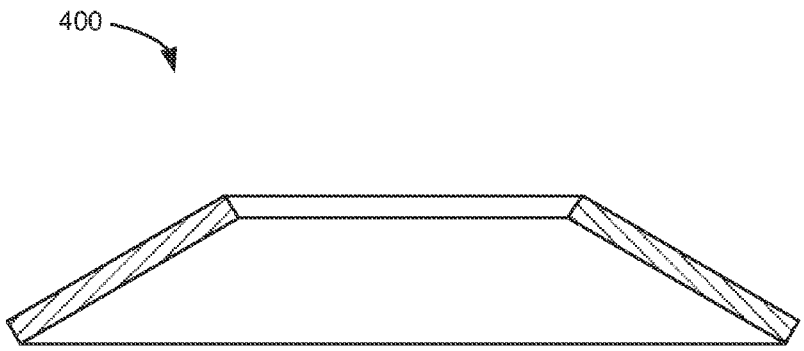
FIG. 4 illustrates a cross-sectional view of an exemplary Belleville washer used in accordance with an exemplary implementation.

In the embodiments described above, two springs 150 or a single spring 250 may be used in connection with magnetic actuator 100/200. In some implementations, springs 150 and 250 may be coil springs/helically wound springs. In other implementations, other types of springs may be used. For example, in another implementation, one or more Belleville type washers, such as Belleville type washer 400, illustrated in a cross-sectional view in FIG. 4, may be used in place of springs 150 and/or spring 250. In still other implementations, a spring made in a tube-like structure may be used in place of springs 150 and/or spring 250.

In addition, two springs 150 were described above with respect to magnetic actuator 100. In other implementations, three or more springs may be used in magnetic actuator 100. For example, four springs located around the circumference of coil bobbin 130 may be used. In such an implementation, the four springs may be offset 90 degrees from each other. In still other implementations, other numbers of springs (e.g., three or five or more) may be used in magnetic actuator 100.

In addition, in the embodiments described above refer to effecting an operation, such as opening or closing a circuit breaker. In other embodiments, magnetic actuator 100/200 may be used to effect other operations, such as opening/closing a valve, turning on/off a switch, etc. In addition, embodiments have been described above with respect to magnetic actuators 100/200 coupled to a pull rod assembly that actuates an operation. In other embodiments, magnetic actuator 100/200 may be used in connection with a push rod assembly that is pushed in a direction away from the magnetic actuator 100/200 to actuate an operation.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, in some implementations, magnetic actuators 100/200 may not include booster magnets 120/220. Further, other types of connection mechanisms may be used to couple magnetic actuators 100/200 to various systems/devices to actuate an operation.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A magnetic actuator, comprising:

a coil bobbin including electrical wire wound around a core;

a plunger located in a central portion of the magnetic actuator and configured to move within a bore located in the central portion;

at least one spring located adjacent the central portion, wherein when electrical current is provided to the electrical wire, an electromagnetic field causes the plunger to move from a first position to a second position and wherein stored energy associated with the at least one spring aids in moving the plunger to the second position;

a linking portion coupled to an upper portion of the plunger and connected to a pull rod assembly, wherein the linking portion is configured to initiate an action via the pull rod assembly based on movement of the plunger; and at least one booster magnet located adjacent the upper portion of the plunger, wherein the at least one booster magnet aids in holding the plunger in the first position when electrical current is not provided to the coil bobbin.

2. The magnetic actuator of claim 1, wherein the at least one spring comprises two springs located on either side of the central portion, the magnetic actuator further comprising:

a housing configured to house the coil bobbin, the plunger, the at least one spring, a portion of the linking portion and the at least one booster magnet.

3. The magnetic actuator of claim 1, wherein the at least one spring comprises one spring located around a circumference of the central portion.

4. The magnetic actuator of claim 1, wherein the at least on spring comprises four springs located around a circumference of the central portion.

5. The magnetic actuator of claim 1, wherein the at least one booster magnet is located adjacent the coil bobbin and a length of the magnetic actuator is less than six inches.

6. The magnetic actuator of claim 1, wherein the linking portion includes a single shaft that is configured to be connected to the pull rod assembly via at least one of a clamp, a threaded connection or a bolt.

7. The magnetic actuator of claim 6, wherein the pull rod assembly operates to open or close a circuit breaker based on linear movement of the plunger.

8. The magnetic actuator of claim 1, wherein the at least one spring comprises a helically wound spring.

9. The magnetic actuator of claim 1, wherein the at least one spring comprises a Belleville washer.

10. A system, comprising:

a circuit breaker;

a moveable assembly coupled to the circuit breaker and configured to open or close the circuit breaker; and a magnetic actuator comprising:

a coil bobbin including electrical wire wound around a core, a plunger located in a central portion of the magnetic actuator and configured to move within an opening located in the central portion, at least one spring located adjacent the central portion, wherein when electrical current is provided to the electrical wire, an electromagnetic field causes the plunger to move from a first position to a second position, wherein stored energy associated with the at least one spring is used to aid in moving the plunger to the second position, a linking portion coupled to an upper portion of the plunger and connected to the moveable assembly, wherein the linking portion is configured to initiate the opening or closing of the circuit breaker via the moveable assembly, and at least one booster magnet located adjacent the upper portion of the plunger, wherein the at least at least one booster magnet operates to hold the plunger in the first position when electrical current is not provided to the electrical wire.

11. The system of claim 10, wherein the at least one booster magnet is located adjacent the coil bobbin.

12. The system of claim 10, wherein the at least one spring comprises two springs located on either side of the central portion.

13. The system of claim 10, wherein the at least one spring comprises one spring located around a circumference of the central portion.

14. The system of claim 10, wherein the at least on spring comprises at least three springs located around a circumference of the central portion.

15. The system of claim 10, wherein the at least one spring comprises a helically wound spring.

16. The system of claim 10, wherein the at least one spring comprises a Belleville washer.

17. The system of claim 10, wherein the circuit breaker comprises a vacuum circuit breaker.

18. The system of claim 10, wherein the moveable assembly comprises a pull rod assembly or push rod assembly that is configured to be pulled or pushed by the linking portion to open the circuit breaker, and wherein the pull rod assembly or push rod assembly include a single shaft that is configured to be connected to the pull rod assembly or push rod assembly via at least one of a clamp, a threaded connection or a bolt.

19. A magnetic actuator, comprising:

a coil bobbin including electrical wire wound around a core;

a plunger located in a central portion of the magnetic actuator and configured to move within a bore located in the central portion;

a booster magnet located adjacent an upper portion of the plunger;

at least one spring located adjacent the central portion, wherein when electrical current is provided to the electrical wire, an electromagnetic field causes the plunger to move from a first position to a second position; and a linking portion coupled to the plunger and a pull rod assembly, wherein the linking portion is configured to initiate an action via the pull rod assembly based on movement of the plunger from the first position to the second position.

20. The magnetic actuator of claim 19, wherein the action comprises opening or closing a circuit breaker and the linking portion is connected to the pull rod assembly via at least one of a clamp, a threaded connection or a bolt.

* * * * *

UNITED STATES PATENT AND TRADEMARK OFFICE

CERTIFICATE OF CORRECTION

PATENT NO. : 8,786,387 B2
APPLICATION NO. : 13/526593
DATED : July 22, 2014
INVENTOR(S) : Fong et al.

It is certified that error appears in the above-identified patent and that said Letters Patent is hereby corrected as shown below:

In the Claims

Claim 4 column 7, line 34, change the word "on" to "one".

Claim 10 column 8, line 11, change the phrase "at least at least" to "at least".

Claim 14 column 8, line 24, change the word "on" to "one".

Signed and Sealed this
Seventh Day of October, 2014

Michelle K. Lee

Michelle K. Lee
*Deputy Director of the United States Patent and Trademark Office*